US008087663B2

(12) United States Patent
Asada et al.

(10) Patent No.: US 8,087,663 B2
(45) Date of Patent: Jan. 3, 2012

(54) SHEET FEEDER AND IMAGE RECORDING APPARATUS

(75) Inventors: Tetsuo Asada, Kuwana (JP); Satoru Nakakita, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 12/729,205

(22) Filed: Mar. 22, 2010

(65) Prior Publication Data

US 2011/0074094 A1 Mar. 31, 2011

(30) Foreign Application Priority Data

Sep. 30, 2009 (JP) ..... 2009-227517

(51) Int. Cl.
*B65H 3/52* (2006.01)

(52) U.S. Cl. ..... 271/121; 271/167

(58) Field of Classification Search ..... 271/137, 271/121, 167

See application file for complete search history.

(56) References Cited

U.S. PATENT DOCUMENTS

| | | | | |
|---|---|---|---|---|
| 6,139,007 | A | 10/2000 | Cahill et al. | |
| 6,279,897 | B1 | 8/2001 | Richards | |
| 6,712,351 | B2 * | 3/2004 | Hsieh | 271/121 |
| 7,690,645 | B2 * | 4/2010 | Koga | 271/167 |
| 7,852,526 | B2 * | 12/2010 | Mo et al. | 358/498 |
| 2002/0163117 | A1 * | 11/2002 | Hsieh | 271/121 |
| 2004/0026845 | A1 | 2/2004 | Park | |
| 2005/0194734 | A1 * | 9/2005 | Asada et al. | 271/121 |
| 2006/0180992 | A1 | 8/2006 | Asada | |
| 2010/0244372 | A1 | 9/2010 | Wakakusa et al. | |
| 2011/0074092 | A1 | 3/2011 | Asada et al. | |
| 2011/0074093 | A1 | 3/2011 | Asada et al. | |

FOREIGN PATENT DOCUMENTS

| | | | |
|---|---|---|---|
| JP | H07-251955 | A | 10/1995 |
| JP | 2002-137838 | A | 5/2002 |
| JP | 2005-247550 | A | 9/2005 |
| JP | 3692129 | B2 | 9/2005 |
| JP | 2006-182481 | A | 7/2006 |

OTHER PUBLICATIONS

The State Intellectual Property Office of the People's Republic of China, Notification of First Office Action for Chinese Patent Application No. 201010148862.0 (counterpart to application related to above-captioned patent application), issued Aug. 3, 2011.

* cited by examiner

*Primary Examiner* — Kaitlin Joerger
(74) *Attorney, Agent, or Firm* — Baker Botts L.L.P.

(57) ABSTRACT

A sheet feeder, including: a holding portion for holding sheets; a sheet supply portion; an inclined member having an inclined surface for guiding each sheet in a sheet feed direction along the inclined surface; a first separation protrusion provided integrally on the inclined member so as to protrude from the inclined surface such that its distal end is located more downstream in the sheet feed direction than its proximal end; a plurality of second separation protrusions formed of a metal and disposed more upstream in the sheet feed direction than the first separation protrusion, each second separation protrusion protruding from the inclined surface through a corresponding one of openings formed in the inclined member, the second separation protrusions being arranged in the sheet feed direction; and a fixing member by which the second separation protrusions are fixed to the inclined member on a surface thereof opposite to the inclined surface.

10 Claims, 6 Drawing Sheets

SHEET FEEDER AND IMAGE RECORDING APPARATUS

CROSS REFERENCE TO RELATED APPLICATION

The present application claims priority from Japanese Patent Application No: 2009-227517, which was filed on Sep. 30, 2009, the disclosure of which is herein incorporated by reference in its entirety.

BACKGROUND OF THE INVENTION

1. Field of the Invention

The present invention relates to a sheet feeder in which sheets are separated by separation protrusions when the sheets held on a holding portion are fed along an inclined member, and an image recording apparatus equipped with such a sheet feeder.

2. Discussion of Related Art

An image recording apparatus such as an ink-jet printer is equipped with a sheet feeder configured to feed recording sheets accommodated in a sheet tray to a sheet transfer path by a rotational force of a roller. The roller is rotated while being held in contact with an uppermost one of the recording sheets on the sheet tray, whereby the rotational force of the roller is transmitted to the uppermost sheet and the uppermost sheet is fed into the sheet transfer path from the sheet tray. As such a sheet feeder, there is known one having a structure in which metal separation protrusions are provided on an inclined guide surface that is disposed at one end of the sheet tray for preventing so-called multiple feeding of the recording sheets (i.e., multiple sheet feeding) in which a plurality of sheets on the sheet tray are fed at one time.

SUMMARY OF THE INVENTION

The separation protrusions described above are formed as follows. A metal plate punched into a suitable shape, and portions of the metal plate that give the separation protrusions are bent so as to stand from a main body of the metal plate. The separation protrusions are inserted through corresponding windows (openings) formed in a guide plate that provides the inclined guide surface, from the back side of the guide plate, whereby the separation protrusions protrude from the inclined guide surface.

For fixing the metal plate to a predetermined position of the guide plate, there is provided a cover that covers the entirety of the metal plate. The cover presses the metal plate onto a back surface of the guide plate opposite to the inclined guide surface and supports the periphery of the metal plate. Each of the cover and the guide plate is a molded product formed of a synthetic resin. The cover is fixed to the guide plate by engagement therewith. The cover that covers the metal plate has a larger size than the metal plate. Accordingly, the guide plate is designed to have a sufficiently larger size than the cover for permitting the cover to be fixed thereto such that the cover does not protrude upwardly from the inclined guide surface. It is, however, desirable that the guide plate has a minimum height dimension in view of demands for reduction in the thickness and the size of the image recording apparatus.

It is therefore an object of the invention to provide a sheet feeder in which an inclined member having separation protrusions for separating sheets has a reduced height and an image recording apparatus equipped with such a sheet feeder.

The above-indicated abject may be attained according to a principle of the invention, which provides a sheet feeder, comprising:

- a holding portion having a holding surface on which a plurality of sheets are held in a stack;
- a supply portion configured to supply the plurality of sheets sequentially from an uppermost one of the plurality of sheets held on the holding portion;
- an inclined member disposed downstream of the holding portion in a direction in which the sheets are supplied by the supply portion and having an inclined surface that faces a leading edge of each of the sheets held on the holding portion while inclining relative to the holding surface, the inclined member being configured to guide said each of the sheets supplied from the holding portion in a sheet feed direction in which said each of the sheets is fed along the inclined surface;
- a first separation protrusion which is provided on and integrally with inclined member and which protrudes from the inclined surface such that a distal end thereof is located more downstream in the sheet feed direction than a proximal end thereof;
- a plurality of second separation protrusions which are formed of a metal and which are disposed more upstream in the sheet feed direction than the first separation protrusion, each of the plurality of second separation protrusions protruding from the inclined surface through a corresponding one of openings formed in the inclined member, the plurality of second separation protrusions being arranged in the sheet feed direction; and
- a fixing member by which the plurality of second separation protrusions are fixed to the inclined member on a surface thereof opposite to the inclined surface.

BRIEF DESCRIPTION OF THE DRAWINGS

The above and other objects, features, advantages and technical and industrial significance of the present invention will be better understood by reading the following detailed description of an embodiment of the invention, when considered in connection with the accompanying drawings, in which.

DETAILED DESCRIPTION OF THE EMBODIMENT

There will be hereinafter described one preferred embodiment of the invention with reference to the drawings. It is to be understood that the embodiment described below may be otherwise modified without departing from the scope of the invention defined in the attached claims.

[Internal Structure of Printer 11]

Figure 1:
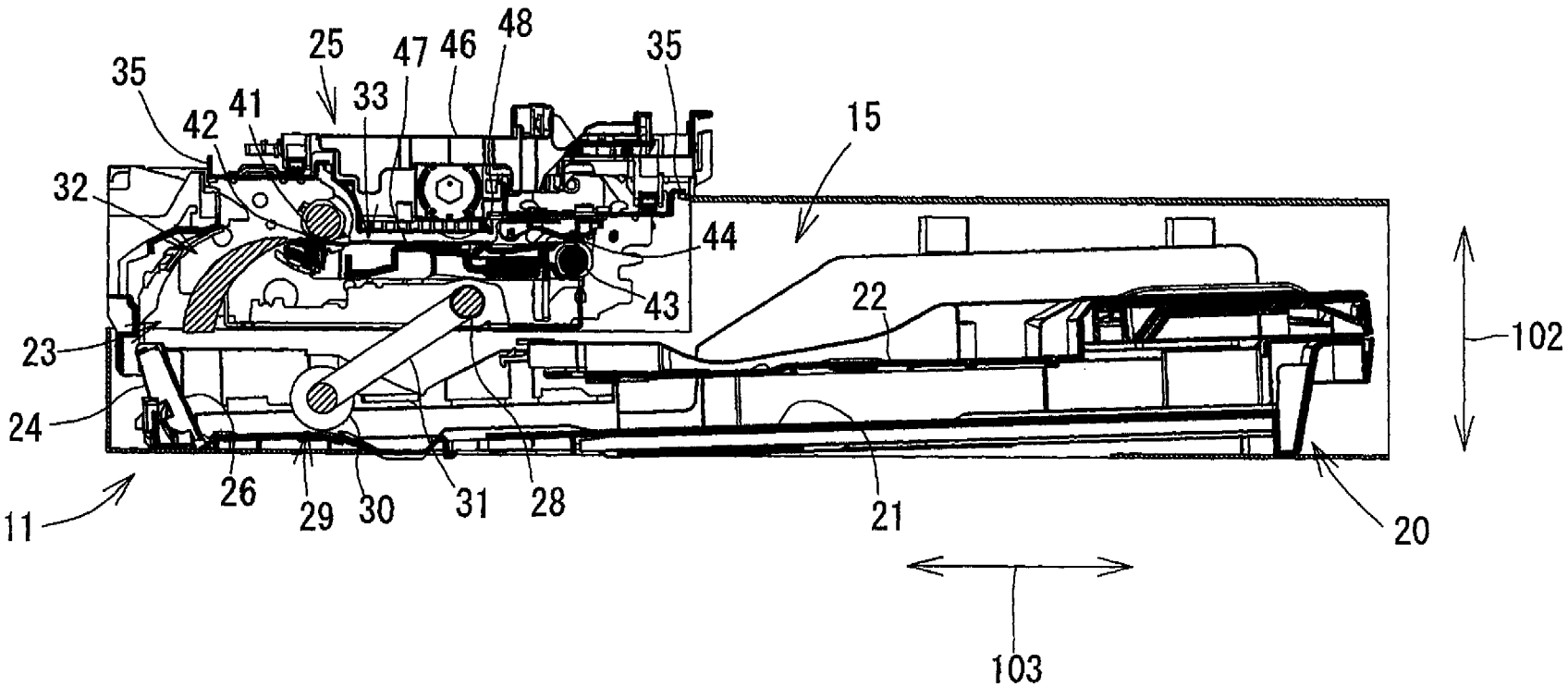
FIG. 1 is a schematic view showing an internal structure of a printer according to one embodiment of the invention.

As shown in FIG. 1, a printer 11 has a sheet transfer path 23 through which each of recording sheets supplied from a sheet cassette 20 is transferred and a recording portion 25 provided in the sheet transfer path 23. In the present embodiment, while the printer 11 will be explained as having only a printing function, the printer 11 may be realized as a multi function device having various functions such as a scanning function, a facsimile function, and a copying function, in addition to the printing function. The printer 11 is an image recording apparatus equipped with a sheet feeder according to the present invention.

In the present embodiment, the directions indicated by arrows 101, 102, 108 in the drawings are a width direction, a height direction, and a depth direction, of the printer 11, respectively. The direction 101 may also be referred to as "a sheet width direction" which is a width direction of each of the recording sheets that is fed. Further, the direction 103 may also be referred to as "a supply direction" in which each of the recording sheets in the sheet cassette 20 is sent.

[Sheet Cassette 20]

As shown in FIG. 1, the sheet cassette 20 is provided so as to be inserted into an inner space 15 of the printer 11 from the front side thereof (the right-hand side in FIG. 1) and withdrawn from the inner space 15 toward the front side, along the depth direction 103. The sheet cassette 20 is a rectangular box whose upper surface is partly open. A plurality of recording sheets are placed or held in a stack on a bottom plate 21 of the sheet cassette 20. The recording sheets placed on the sheet cassette 20 are fed into the sheet transfer path 23 by a sheet supply roller 30. A sheet receiving tray 22 is constituted as a part of the upper surface of the sheet cassette 20. Each of the recording sheets outputted from the sheet transfer path 23 is placed on the sheet receiving tray 22. The sheet cassette 20 is a holding portion, and the upper surface of the bottom plate 21 is a holding surface. Each recording sheet is one example of a sheet.

On the rear side of the sheet cassette 20, there is disposed an inclined member 24 that stands relative to the bottom plate 21. The inclined member 24 is disposed downstream of the recording sheets placed on the bottom plate 21 in the supply direction 103 and has a flat plate-like shape extending in the width direction 101. The inclined member 24 is inclined such that its upper end portion is located more downstream than its lower end portion in the sheet feed direction 104. Owing to the inclination of the inclined member 24, an inclined surface 26 with which the leading edge of each of the recording sheets comes into contact is formed so as to face the leading edge of each of the sheets on the bottom plate 21. The upper surface of the bottom plate 21 is substantially horizontal when the sheet cassette 20 is installed on the printer 11. The upper surface of the bottom plate 21 and the inclined surface 26 form a predetermined angle. The inclined member 24 will be explained in detail.

[Sheet Transfer Path 28]

As shown in FIG. 1, the sheet transfer path 23 has a curved portion 32 by which each recording sheet is guided so as to be transferred in a curved form and a straight portion 38 by which the sheet is guided so as to be transferred straight. The curved portion 32 extends upward from the rear side of the sheet cassette 20 (i.e., from the left-hand side in FIG. 1) and is curved toward the front side of the printer 11 (i.e., toward the right-hand side in FIG. 1). The straight portion 33 extends straight from the curved portion 32 toward the front side of the printer 11 near to the sheet receiving tray 22. The recording sheets are supplied from the sheet cassette 20 sequentially to the curved portion 32 and the straight portion 33. The sheet transfer path 23 is a so-called U-turned path constituted by the curved portion 32 and the straight portion 33.

[Supply Portion 29]

As shown in FIG. 1, the supply portion 29 includes a sheet supply roller 30 and an arm 31. The sheet supply roller 30 is pivotably supported at a distal end portion of the arm 31. The arm 31 is pivotable about a pivot axis 28 whose axial direction coincides with the width direction 101. The sheet supply roller 30 is configured to be inserted, by the pivotal movement of the arm 31, into the sheet cassette 20, so as to come into contact with an uppermost one of the recording sheets stacked on the bottom plate 21. The sheet supply roller 30 is rotated by a drive force transmitted from a motor not shown. When the sheet supply roller 30 is rotated while being held in pressing contact with the uppermost one of the sheets stacked on the sheet cassette 20, the uppermost sheet is fed into the sheet transfer path 23 by a frictional force generated between the uppermost sheet and the sheet supply roller 30.

The above-indicated supply portion 29 and sheet cassette 20 constitute a sheet feeder according to the invention.

[Sheet Transfer Mechanism]

A sheet transfer roller 41 and a pinch roller 42 are provided in the straight portion 33 of the sheet transfer path 23. These rollers 41, 42 are disposed on a more upstream side than the recording portion 25 in a direction in which the sheet is transferred. The sheet transfer roller 41 and the pinch roller 42 form a pair. The pinch roller 42 is movable so as to come into contact with and retract from the sheet transfer roller 41, and is biased by a spring for pressing contact with the sheet transfer roller 41. The sheet transfer roller 41 is configured to be rotated by a drive force transmitted from a motor not shown. The recording sheet held by and between the sheet transfer roller 41 and the pinch roller 42 is transferred to the recording portion 25 by the rotation of the sheet transfer roller 41.

A sheet discharge roller 43 and a spur 44 are provided in the straight portion 33 of the sheet transfer path 23. The sheet discharge roller 43 and the spur 44 are disposed on a more downstream side than the recording portion 25 in the direction in which the sheet is transferred. The sheet discharge roller 43 and the spur 44 form a pair. The spur 44 is movable so as to come into contact with and retract from the sheet discharge roller 43, and is biased by a spring for pressing contact with the sheet discharge roller 43. The sheet discharge roller 43 is configured to be rotated by a drive force transmitted from a motor not shown. The rotation of the sheet discharge roller 43 is synchronism with the rotation of the sheet transfer roller 41. The recording sheet held by and between the sheet discharge roller 43 and the spur 44 is transferred to the sheet receiving tray 22 by the rotation of the sheet discharge roller 43.

[Recording Portion 25]

As shown in FIG. 1, the recording portion 25 is disposed on the straight portion 33 of the sheet transfer path 28 and includes a carriage 46 and a platen 47. The carriage 46 is disposed on the upper side of the platen 47 with the straight portion 33 interposed therebetween. A recording head 48 is mounted on the carriage 46. While not shown in FIG. 1, the recording head 48 has nozzles from which ink droplets are ejected. The recording head 48 is mounted on the carriage 46 such that openings of the nozzles are exposed toward the platen 47.

The carriage 46 is configured to reciprocate, together with the recording head 48, in the width direction 101, i.e., in a direction perpendicular to the sheet plane of FIG. 1, by a drive force transmitted thereto from a motor not shown. The carriage 46 is prevented from moving in the depth direction 108 by engagement thereof with a guide rail 35 that extends in the width direction 101.

During the reciprocating movement of the carriage 46 in the width direction 101, minute ink droplets are selectively ejected from the recording head 48 toward the recording sheet on the platen 47. The ejected ink droplets are attached to the recording sheet, whereby an image is recorded on the recording sheet. The ink is supplied from an ink cartridge not shown to the recording head 48. The recording portion 25 is one kind of a recording device.

[Inclined Member 24]

Figure 2:
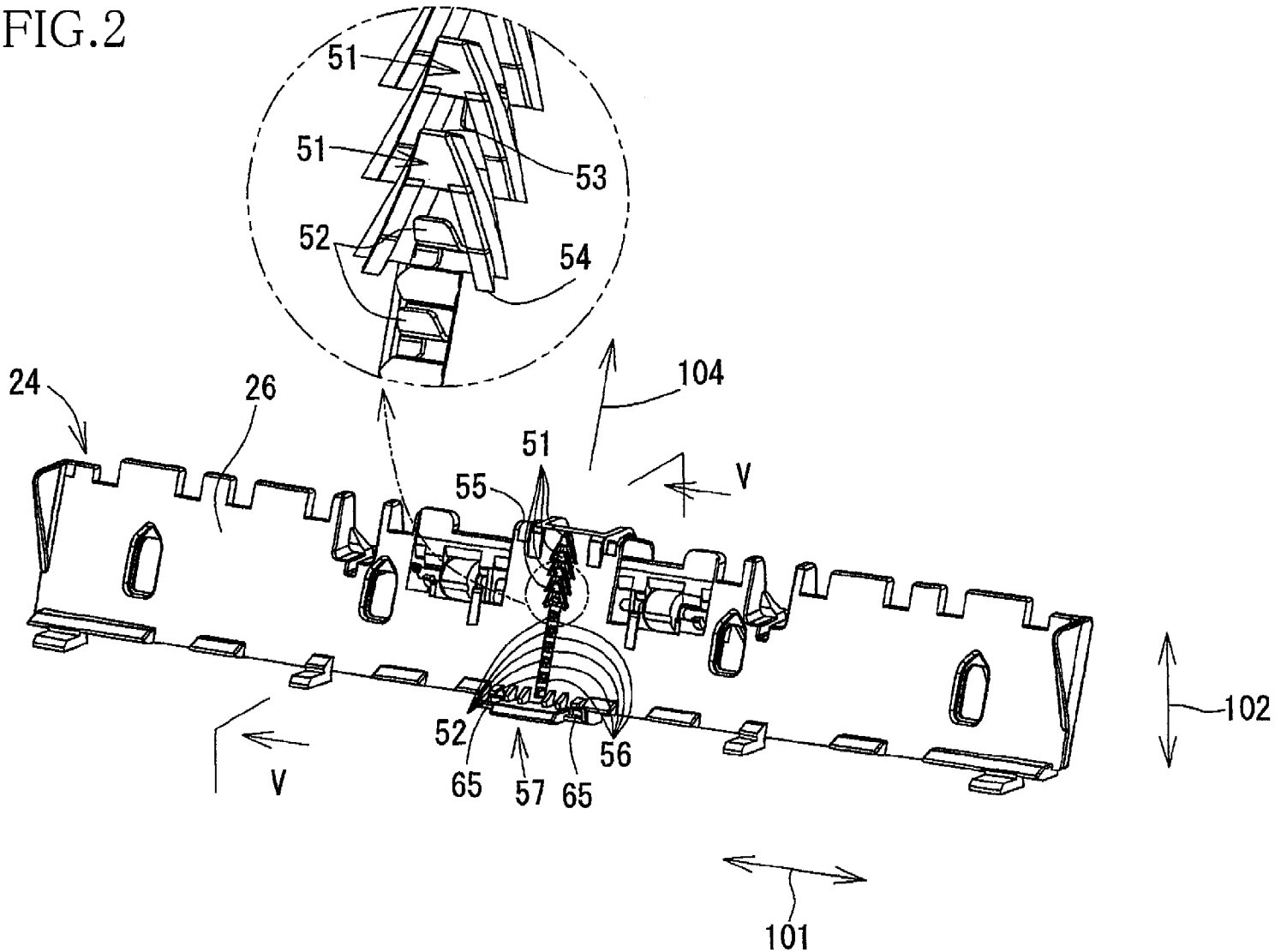
FIG. 2 is a perspective view showing an external appearance of an inclined member on the side of an inclined surface.

As shown in FIG. 2, the inclined member 24 has a flat plate shape that is long in the width direction 101. The dimension of the inclined member 24 as measured in the width direction 101 is made larger than the width of a maximum size of the recording sheet that can be placed on the sheet cassette 20. One of opposite surfaces of the inclined member 24 (shown in FIG. 2) that faces the recording sheets on the sheet cassette 20 is an inclined surface 26. The inclined surface 26 may be a flat plane or a curved plane that is slightly curved along the width direction 101. The inclined surface 26 is configured to contact the leading edge of the recording sheet supplied by the supply portion 29 and to guide the recording sheet slantingly in the upward direction. For smooth guiding of the recording sheet, the inclined surface 26 is formed of a material having a low degree of sliding resistance.

The angle defined by the inclined surface 26 and the upper surface of the bottom plate 21 is determined to be a suitable value that permits the recording sheet to be flexed without stopping for changing the traveling direction of the sheet to the slantingly upward direction, when the recording sheet placed on the bottom plate 21 of the sheet cassette 20 is fed and its leading edge comes into contact with the inclined surface 26. Where the angle defined by the inclined surface 26 and the upper surface of the bottom plate 21 becomes large or becomes close to 90°, namely, where the inclined surface 26 is formed so as to become close to a vertical plane, the recording sheet tends to stop when its leading edge comes into contact with the inclined surface 26, thereby causing a risk of so-called sheet misfeeding or sheet feeding failure in which the recording sheet is not actually fed even though the sheet supply roller 30 operates to feed the sheet. On the other hand, when the angle defined by the inclined surface 26 and the upper surface of the bottom plate 21 becomes small or becomes close to 0°, the height of the inclined surface 26 decreases, resulting in a decrease of the number of the recording sheets that can be placed on the sheet cassette 20. Accordingly, the angle of the inclined surface 26 relative to the bottom plate 21 is suitably set such that the recording sheet can be smoothly guided while taking account of the number of the sheets placed on the sheet cassette 20.

As shown in FIG. 2, there are provided, on the inclined surface 26 of the inclined member 24, first separation protrusions 51 and second separation protrusions 52. The first separation protrusions 51 are formed integrally with the inclined member 24 and are elastically deformable. Where the inclined member 24 is formed of a synthetic resin, for instance, the first separation protrusions 51 are formed integrally with the inclined member 24 by molding. In the present embodiment, four first separation protrusions 51 are arranged in a row in the sheet feed direction 104 at a position of the inclined surface 26 which is middle in the width direction 101 and which is the same as the position of the sheet supply roller 30 in the width direction 101.

Figure 5:
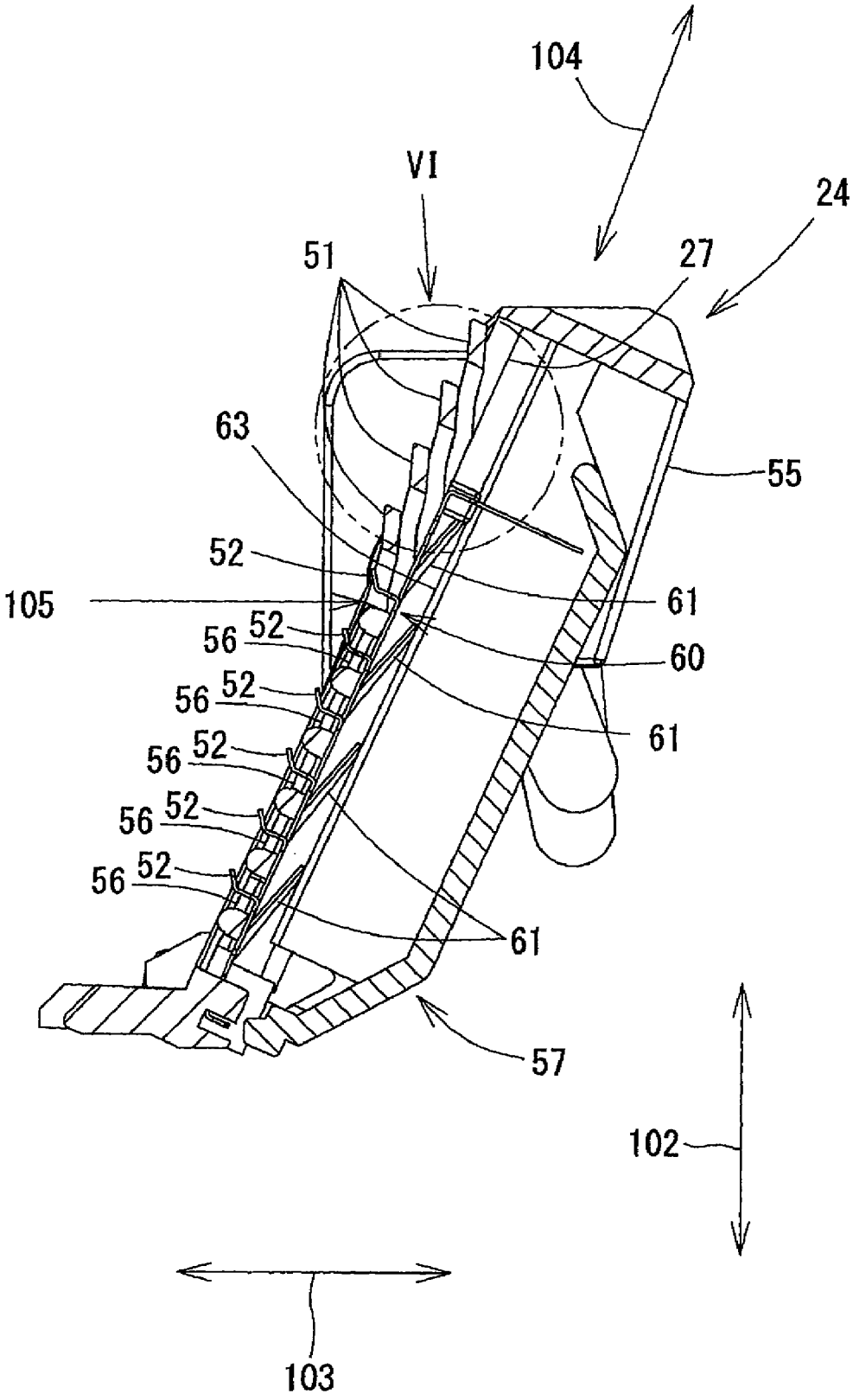
FIG. 5 is a cross-sectional view taken along line V-V in FIG. 2.
Figure 6:
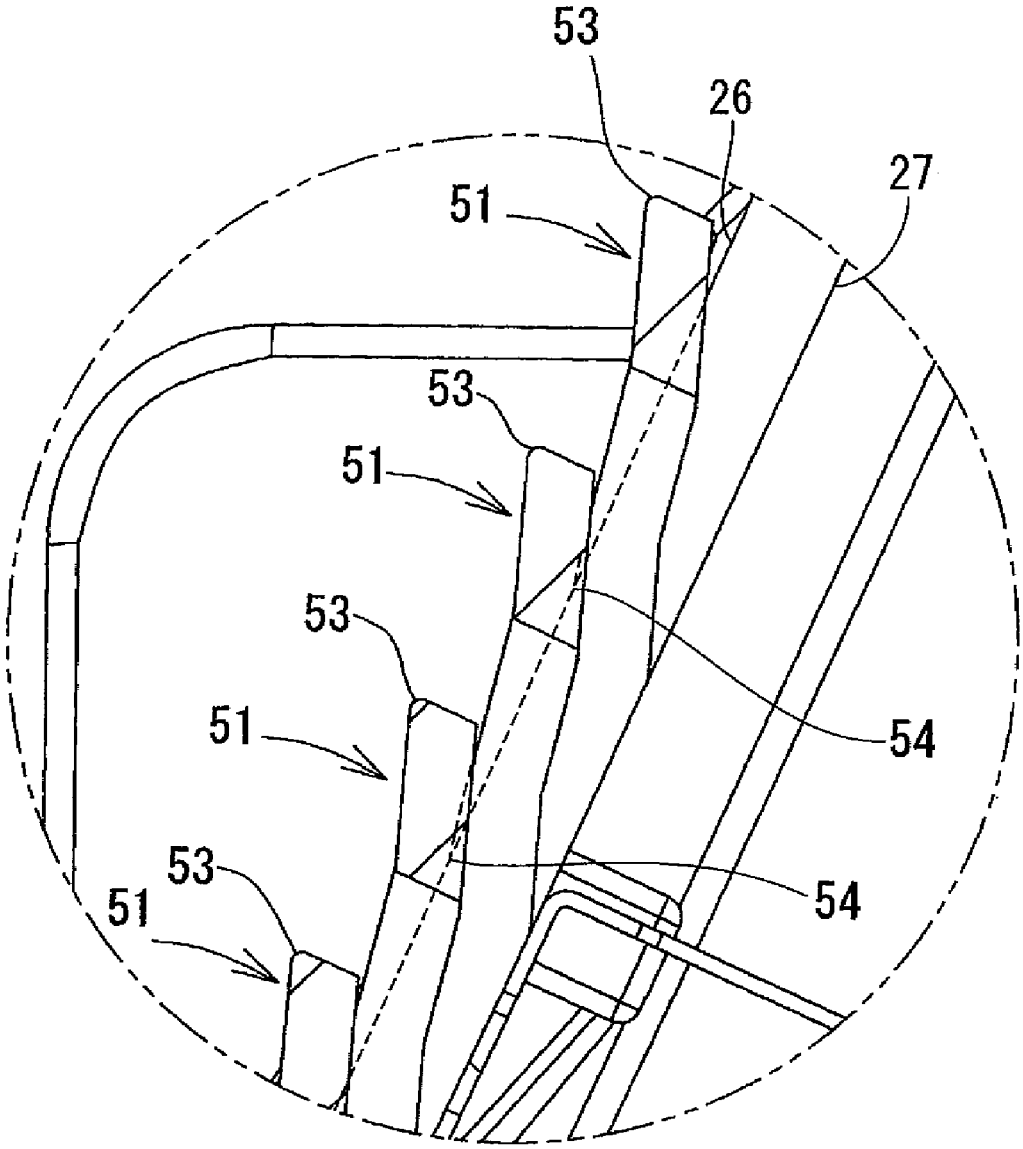
FIG. 6 is an enlarged cross-sectional view of a circled portion indicated by an arrow VI in FIG. 5.

As shown in FIG. 5, all of the first separation protrusions 51 are disposed on an upper side of, namely, on a downstream side of a specific position 105 on the inclined surface 26 with which the leading edge of the uppermost one of the recording sheets is in contact at a time when a maximum amount of the recording sheets are placed on the bottom plate 21 of the sheet cassette 20. In other words, each of the first separation protrusions 51 is disposed at a height position which is higher than a height position of the uppermost one of the plurality of sheets at a time when a maximum amount of the sheets are placed on the bottom plate 21. Each first separation protrusion 51 protrudes from the inclined surface 26 toward the recording sheets on the bottom plate 21 of the sheet cassette 20, and has two arms at its proximal end 54 that are integrally connected to each other at its distal end 53. As shown in FIG. 6, each first separation protrusion 51 protrudes toward the downstream side in the sheet feed direction 104 slantingly relative to the inclined surface 26. That is, a portion of each first separation protrusion 51 near to the distal end 53 is located more downstream in the sheet feed direction 104 than a portion thereof near to the proximal end 54. Each first separation protrusion 51 is configured to be elastically deformable so as to fall clown toward the inclined surface 26 when the recording sheet contacts the first separation protrusion 51.

As shown in FIG. 6, the protrusion amount of each first separation protrusion 51 in the sheet feed direction 104 is set such that the distal end 53 of one first separation protrusion 51 is located more downstream in the sheet feed direction 104 than the proximal end 54 of another first separation protrusion 51 that is located adjacent to and immediately downstream of that one first separation protrusion 51 in the sheet feed direction 104. That is, each first separation protrusion 51 is formed such that one first separation protrusion 51 partly overlaps another first separation protrusion 51 located immediately downstream thereof in the sheet feed direction 104, as seen in a direction perpendicular to the inclined surface 26. Accordingly, the distal end 53 of one first separation protrusion 51 is located between the two arms at the proximal end 54 of another first separation protrusion that is located immediately downstream of that one first separation protrusion 51 in the sheet feed direction 104.

As shown in FIG. 2, each first separation protrusion 51 has a tapered shape in which its width dimension as measured in the width direction 101, i.e., a distance from one of the two arms to the other of the two arms, gradually decreases from the proximal end 54 toward the distal end 53. In other words, each first separation protrusion 51 has a trapezoidal shape in which the width dimension at the distal end 53 is smaller than that at the proximal end 54, as seen in the direction perpendicular to the inclined surface 26.

As shown in FIG. 2, the second separation protrusions 52 are provided cm the inclined surface 26 of the inclined member 24 so as to be disposed upstream of the first separation protrusions 51 in the sheet feed direction 104. The second separation protrusions 52 are disposed so as be arranged in one row in the sheet feed direction 104, together with the first separation protrusions 51, at the middle position of the inclined surface 26 in the width direction 101.

Figure 4:
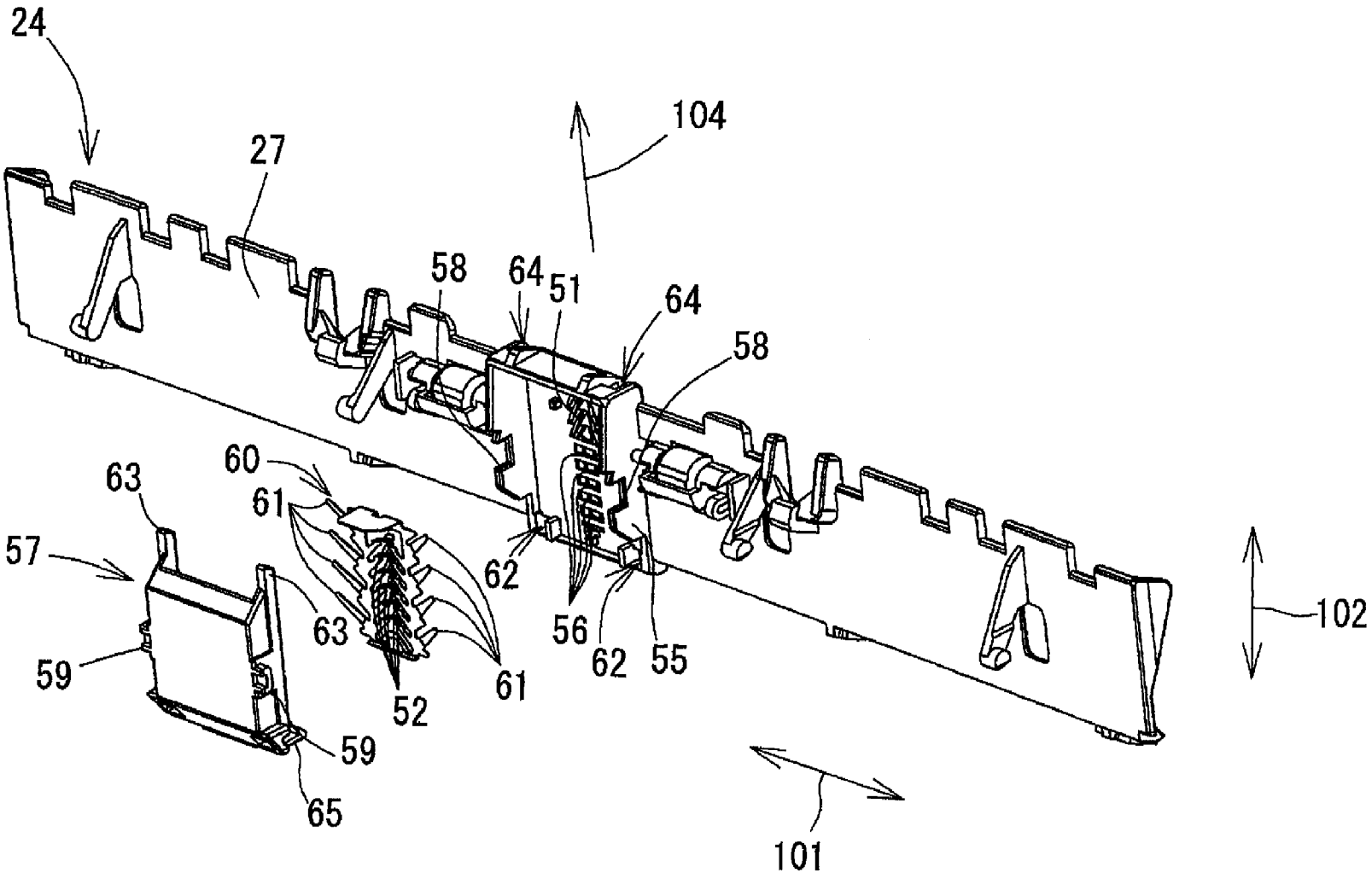
FIG. 4 is an exploded perspective view of the inclined member.

As shown in FIG. 4, the second separation protrusions 52 are provided by a metal spring plate member 60 that is prepared separately from the inclined member 24. The spring plate member 60 is formed by punching and bending of a metal plate. A plurality of elastic legs 61 are formed so as to extend from opposite sides of the spring plate member 60 in the width direction 101. Each elastic leg 61 is slightly bent so as to extend in a direction away from the inclined member 24. The elastic legs 61 may be referred to as a peripheral portion.

At a middle position of the spring plate member 60 in the width direction 101, six second separation protrusions 52 are formed by punching and bending. Each second separation protrusion 52 stands from a main body of the spring plate member 60 toward the inclined member 24 and is bent in a suitable direction. The amount by which each second separation protrusion 52 stands from the main body of the spring plate member 60 is determined depending upon the thickness of the inclined member 24. As shown in FIG. 2, when the spring plate member 60 is installed on the inclined member 24, the second separation protrusions 52 protrude from the inclined surface 26 toward the recording sheets on the bottom plate 21.

As shown in FIG. 4, a boxlike wall 55 within which the spring plate member 60 is accommodated is formed at a middle position of a back surface 27 of the inclined member 24 that is opposite to the inclined surface 26, so as to extend from the back surface 27. The spring plate member 60 is accommodated in a space enclosed by the wall 55 and is held in contact with the back surface 27. In a region of the back surface 27 enclosed by the wall 55, there are formed openings 56 through which the second separation protrusions 52 are respectively inserted from the side of the back surface 27 toward the side of the recording sheets on the bottom plate 21. All of the openings 56 are disposed on the upstream side of the first separation protrusions 51 in the sheet feed direction 104. The openings 56 are formed through the thickness of the inclined member 24 and are formed at regular intervals along the sheet feed direction 104 at the middle position of the inclined member 24 in the width direction 101. The number of the openings 56 and the pitch at which the openings 56 are formed are determined depending upon the number and the pitch of the second separation protrusions 52. The dimension of each opening 56 as measured in the sheet feed direction 104 is made sufficiently larger than that of a protruded portion of each second separation protrusion 52 that protrudes from the inclined surface 26. Accordingly, the second separation protrusions 52 are elastically deformable in the sheet feed direction 104 in a state in which the second separation protrusions 52 protrude from the respective openings 56. Each second separation protrusion 52 is configured to be elastically deformed when the recording sheet fed along the inclined surface 26 pushes the second separation protrusion 52.

Figure 3:
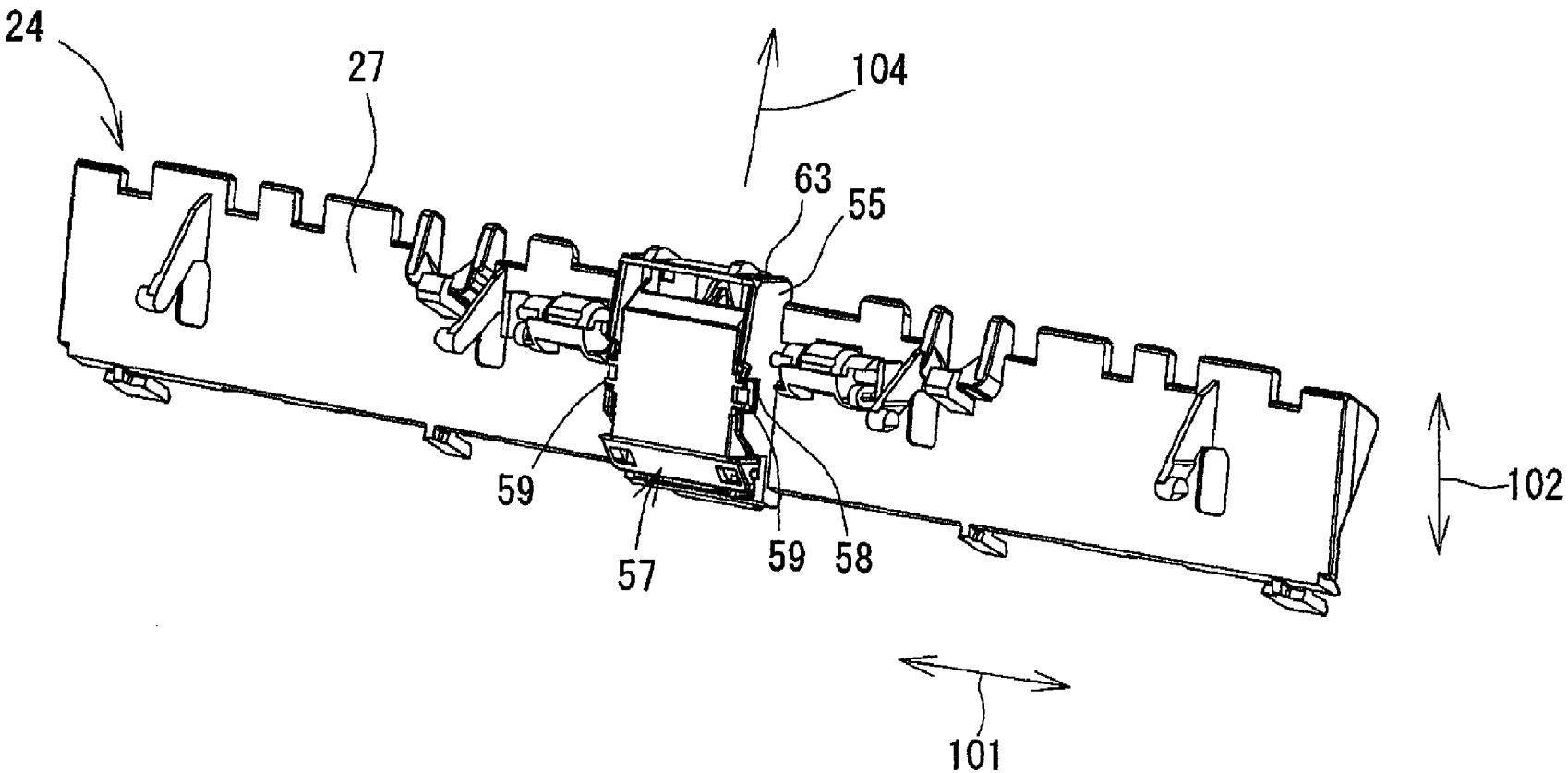
FIG. 3 is a perspective view showing an external appearance of the inclined member on the side of a back surface.

As shown in FIG. 3, a cover 57 as a fixing member is attached to the wall 55 that stands from the back surface 27. The cover 57 is a boxlike member having a size that permits the cover 57 to be fitted into the inside of the wall 55 and that permits the cover 57 to completely cover the spring plate member 60. As shown in FIG. 4, the wall 55 is formed with a pair of cutouts 58 that are spaced apart from each other in the width direction 101. The cover 57 is formed with a pair of projections 59 each extending in the width direction 101, so as to correspond to the cutouts 58 of the wall 55. The projections 59 of the cover 57 are fitted in the respective cutouts 58 of the wall 55; whereby the cover 57 is positioned relative to the wall 55 in the sheet feed direction 104.

As shown in FIG. 4, a pair of pressing portions 63 each extending in the sheet feed direction 104 are formed at respective positions of the cover 57 that face the back surface 27 of the inclined member 24. The pressing portions 63 are spaced apart from each other in the width direction 101. At the upper end of the wall 55, a pair of through-holes 64 into which the upper end portions of the pressing portions 63 of the cover 57 are respectively inserted are formed so as to be spaced apart from each other in the width direction 101.

As shown in FIGS. 2 and 4, a pair of hook portions 65 which are to be held in engagement with the inclined member 24 are formed at the lower end of the cover 57 so as to be spaced apart from each other in the width direction 101. A pair of through-holes 62 that are spaced apart from each other in the width direction 101 are formed in the vicinity of the lower end of the inside of the wall 55, so as to correspond to the hook portions 65 of the cover 57. With the upper end portions of the pressing portions 63 of the cover 57 inserted through the respective through-holes 64 of the wall 55, the hook portions 65 of the cover 57 are inserted into the respective through-holes 62 of the wall 55 for engagement With the inclined member 24, whereby the cover 57 is attached to the inclined member 24.

As shown in FIG. 5, in a state in which the cover 57 is attached to the inclined member 24, the pressing portions 63 of the cover 57 cooperate with the back surface 27 of the inclined member 24 so as to support or hold the elastic legs 61 of the spring plate member 60 therebetween. The elastic legs 61 are elastically deformed toward the back surface 27, whereby the main body of the spring plate member 60 is biased in a direction in which the second separation protrusions 52 protrude from the respective openings 56, by a force to restore the elastic deformation of the spring plate member 60.

[Separation of Recording Sheets]

The recording sheets are inserted onto the bottom plate 21 of the sheet cassette 20 from the front side of the printer 11. The inserted recording sheets slide on the bottom plate 21 or on other recording sheets which have been already placed on the bottom plate 21, so that the leading edges of the recording sheets come into contact with the inclined surface 26. When the recording sheets are loaded onto the sheet cassette 20 with a great force, the leading edges of the sheets tend to move in the slantingly upward direction along the inclined surface 26. However, the leading edges of the sheets come into contact with the second separation protrusions 52 disposed on the lower side of the specific position 105, whereby the sheets are prevented from moving toward the upper side of the specific position 105.

When the supply portion 29 operates, the uppermost one of the sheets stacked on the bottom plate 21 of the sheet cassette 20 is fed in the sheet feed direction 104 by the rotation of the sheet supply roller 30. On this occasion, the recording sheets under the uppermost sheet are sometimes fed in the sheet feed direction 104 together with the uppermost sheet, due to the friction, the static electricity, generated between the sheets, or the like. The leading edges of the thus fed recording sheets come into contact with at least one of the first separation protrusions 51 and the second separation protrusions 52 when the sheets are guided in the slantingly upward direction along the inclined surface 26.

The recording sheets are further moved or fed in the sheet feed direction 104 such that the leading edges thereof slide on at least one of the first separation protrusions 51 and the second separation protrusions 52. Each of the first separation protrusions 51 and each of the second separation protrusions 52 are inclined such that an angle defined by the upper surface of the bottom plate 21 and a contact surface of the first separation protrusion 51 or the second separation protrusion 52 with which the sheet comes into contact is made larger than an angle defined by the upper surface of the bottom plate 21 and the inclined surface 26. In other words, each first separation protrusion 51 and each second separation Protrusion 52 are formed so as to become close to a vertical plane. Accordingly, each of the first and second separation protrusion 51, 52 protrude from the inclined surface 26 toward the recording sheets on the bottom plate 21. Therefore, each of the first and second separation protrusion 51, 52 exhibits, with respect to the leading edges of the recording sheets, a braking action to hinder the feeding of the recording sheets in the sheet feed direction 104. According to the arrangement, the braking action of each first separation protrusion 51 or the braking action of each second separation protrusion 52 works on the recording sheets which are fed in the sheet feed direction 104 by a smaller force, namely, the recording sheets other than the uppermost sheet contacting the sheet supply roller 30, among the recording sheets to come into sliding contact with the first separation protrusions 51 or the second separation protrusions 52.

In an instance where the recording sheets other than the uppermost sheet cannot be completely stopped in spite of the above-described braking action of one first separation protrusion 51 or one second separation protrusion 52 on which the sheets have slid, and pass over that one first or second separation protrusion 51, 52 after all, the recording sheets subsequently come into contact with next first or second separation protrusion 51, 52 that is disposed immediately downstream of that one first or second separation protrusion 51, 52 in the sheet feed direction 104. In particular, the first separation protrusions 51 are provided on the inclined surface 26 such that any adjacent two first separation protrusions 51 partly overlap each other as described above. Accordingly, the leading edges of the recording sheets come into contact with the next first separation protrusion 51 without contacting the inclined surface 26 after having passed over that one first separation protrusion 51. Thus, the above-described braking action is always exhibited, with respect to the recording sheets, between any adjacent two first separation protrusions 51.

Unlike the lust separation protrusions 51, the second separation protrusions 52 do not overlap each other. However, when the leading edges of the recording sheets reach the next second separation protrusion 52 located immediately downstream of the one second separation protrusion 52 over which the leading edges of the recording sheets have passed, the above-described braking action is similarly exhibited. Should the leading edges of the recording sheets pass over all of the second separation protrusions 52, the first separation protrusions 51 are disposed on the downstream side of the second separation protrusions 52 in the sheet feed direction 104. Accordingly, every time when the leading edges of the recording sheets pass over each first separation protrusion 51, the recording sheets repeatedly undergo the braking action, whereby the leading edges of the recording sheets are separated.

In the illustrated embodiment, the first separation protrusions 51 and the second separation protrusions 52 are arranged in a row in the sheet feed direction 104 so as to protrude from the inclined surface 26, whereby the leading edges of the recording sheets are separated by the first separation protrusions 51 or the second separation protrusions 52. Accordingly, the arrangement prevents the multiple sheet feeding in which a plurality of sheets are fed at a time so as to overlap each other.

In the illustrated embodiment, the first separation protrusions 51 are disposed on the inclined member 24 so as to be located on the upper side of, namely, on the downstream side of the second separation protrusions 52. Accordingly, it is possible to reduce the area in which the second separation protrusions 52 are disposed, without lowering the sheet separation ability. The reduction in the area of the second separation protrusions 52 results in a reduction in the size of the spring plate member 60, so that the cover 57 that supports the elastic legs 61 of the spring plate member 60 can be downsized. Accordingly, the size of the inclined member 24 can be reduced in the height direction 102, leading to slimming down of the sheet cassette 20 and accordingly slimming down of the printer 11 as a whole.

Each of the first separation protrusions 51 is formed such that the distal end 53 of one first separation protrusion 51 is located more downstream in the sheet feed direction 104 than the proximal end 54 of another first separation protrusion 51 that is located immediately downstream of that one first separation protrusion 51 in the sheet feed direction 104. Accordingly, after the leading edges of the recording sheets have passed over the one first separation protrusion 51, the leading edges come into contact with the next first separation protrusion 51 located immediately downstream of the one first separation protrusion 51, without contacting the inclined surface 26. Therefore, the above-described braking action is always exhibited with respect to the recording sheets, resulting in improved sheet separation ability.

The first separation protrusions 51 are disposed on the upper side of, namely, on the downstream side of, the specific position 105 of the inclined surface 26 with which the uppermost one of the recording sheets comes into contact at a time when a maximum amount of the recording sheets are placed on the bottom plate 21 of the sheet cassette 20, and the second separation protrusions 52 are disposed on the lower side of, namely, on the upstream side of, the specific position 105. When the recording sheets are placed on the bottom plate 21 of the sheet cassette 20, the leading edges of the recording sheets that have contacted the inclined surface 26 come into contact with the second separation protrusions 52, so that the recording sheets are prevented from traveling in the sheet feed direction 104 along the inclined surface 26. Such an effect, in other words, the effect of preventing the leading edges of the recording sheets from jumping out of the sheet cassette 20 when the sheets are loaded on the sheet cassette 20, can be ensured for a long time period with high stability since each second separation protrusion 52 is formed of a metal that is hard to change with a lapse of time, as compared with a synthetic resin.

Since the first separation protrusions 51 and the second separation protrusions 52 are formed in one row along the sheet feed direction 104, the leading edge of each recording sheet that is fed on the inclined surface 26 comes into contact with the first and second separation protrusions 51, 52 constantly at the same position of the inclined surface 26 in the width direction 101. Accordingly, it is easy to design the layout of the first separation protrusions 51, the second separation protrusions 52, the sheet supply roller 30, and so on, so as to prevent skewing of the recording sheet due to contact with the first separation protrusions 51 and the second separation protrusions 52.

The plurality of second separation protrusions 52 are arranged in the sheet feed direction 104, so that the number of contact of the leading edge of the recording sheet with the second protrusions 52 increases. Accordingly, the sheet separation ability can be improved.

[Modifications]

The first separation protrusions 51 and the second separation protrusions 52 may be disposed at mutually different positions on the inclined surface 26 in the width direction 101. Further, the row of the first separation protrusions 51 and the second separation protrusions 52 may be arranged in a plural number in the width direction 101.

While the plurality of first separation protrusions 51 are provided in the illustrated embodiment, the number of the first separation protrusion 51 may be at least one. Where the plurality of first separation protrusions 51 are provided, the first separation protrusions 51 may not overlap each other.

The positions of the respective first separation protrusions 51 may be on the upper side or on the lower side of the above-indicated position of the inclined surface 26 with which the leading edge of the uppermost one of the recording sheets come into contact at a time when a maximum amount of the recording sheets axe placed on the bottom plate 21 of the sheet cassette 20.

The inclined member 24 need not be formed integrally with the sheet cassette 20, provided that the inclined member 24 is disposed to face the leading edges of the recording sheets. Accordingly, the inclined member 24 may be provided on the printer 11 so as to be independently of the sheet cassette 20.

It is to be understood that the present invention may be otherwise embodied with various changes and modifications, which may occur to those skilled in the art, without departing from the scope of the invention defined in the attached claims.

What is claimed is:

1. A sheet feeder, comprising:

a holding portion having a holding surface on which a plurality of sheets are held in a stack;

a supply portion configured to supply the plurality of sheets sequentially from an uppermost one of the plurality of sheets held on the holding portion;

an inclined member disposed downstream of the holding portion in a direction in which the sheets are supplied by the supply portion and having an inclined surface that faces a leading edge of each of the sheets held on the holding portion while inclining relative to the holding surface, the inclined member being configured to guide said each of the sheets supplied from the holding portion in a sheet feed direction in which said each of the sheets is fed along the inclined surface;

a first separation protrusion which is provided on and integrally with the inclined member and which protrudes from the inclined surface such that a distal end thereof is located more downstream in the sheet feed direction than a proximal end thereof;

a plurality of second separation protrusions which are formed of a metal and which are disposed more upstream in the sheet feed direction than the first separation protrusion, each of the plurality of second separation protrusions protruding from the inclined surface through a corresponding one of openings formed in the inclined member, the plurality of second separation protrusions being arranged in the sheet feed direction; and a fixing member by which the plurality of second separation protrusions are fixed to the inclined member on a surface thereof opposite to the inclined surface, wherein the first separation protrusion is configured to be elastically deformed by being pushed by any of the sheets that is fed.

2. The sheet feeder according to claim 1, wherein each of the second separation protrusions is configured to be elastically deformed by being pushed by any of the sheets that is fed.

3. The sheet feeder according to claim 1, wherein the inclined member and the first separation protrusion are formed of a synthetic resin.

4. The sheet feeder according to claim 1, comprising a metal plate member disposed on the surface of the inclined member opposite to the inclined surface and having a plurality of protruding portions, wherein the plurality of protruding portions serve as the plurality of second separation protrusions by protruding from the inclined surface through the respective openings, and wherein the plate member is fixed, by the fixing member, to the surface of the inclined member opposite to the inclined surface, whereby the plurality of second separation protrusions are fixed to the inclined member.

5. The sheet feeder according to claim 1, wherein the first separation protrusion and the plurality of second separation protrusions are arranged in a row in the sheet feed direction.

6. The sheet feeder according to claim 1, comprising a plurality of first separation protrusions each as the first separation protrusion.

7. The sheet feeder according to claim 6, wherein the plurality of first separation protrusions and the plurality of second separation protrusions are arranged in a row in the sheet feed direction.

8. The sheet feeder according to claim 6, wherein each of the plurality of first separation protrusions protrudes from the inclined surface such that the distal end of one of the plurality of first separation protrusions is located more downstream in the sheet feed direction than the proximal end of another of the plurality of first separation protrusions that is located immediately downstream of the one of the plurality of first separation protrusions in the sheet feed direction.

9. The sheet feeder according to claim 1, wherein the supply portion includes: an arm provided so as to be pivotable in an upward and downward direction about a proximal end portion thereof; and a roller provided at a distal end portion of the arm and configured to be rotated while being in contact with the uppermost one of the plurality of sheets held on the holding portion.

10. An image recording apparatus, comprising:

the sheet feeder defined in claim 1; and a recording portion configured to record an image on said each of the sheets that is fed by the sheet feeder.

* * * * *